US006871591B2

(12) United States Patent
Buono et al.

(10) Patent No.: US 6,871,591 B2
(45) Date of Patent: Mar. 29, 2005

(54) SPRAY COATING METHOD OF PRODUCING PRINTING BLANKETS

(75) Inventors: Ronald M. Buono, Flat Rock, NC (US); Joseph Carl Kalchbrenner, Greer, SC (US); A. Keith Dye, Inman, SC (US); Christopher G. Hayden, Alexandria, VA (US)

(73) Assignee: Reeves Brothers, Inc., Spartanburg, SC (US)

( * ) Notice: Subject to any disclaimer, the term of this patent is extended or adjusted under 35 U.S.C. 154(b) by 0 days.

(21) Appl. No.: 10/101,184

(22) Filed: Mar. 20, 2002

(65) Prior Publication Data

US 2003/0116044 A1 Jun. 26, 2003

Related U.S. Application Data

(60) Provisional application No. 60/309,205, filed on Aug. 2, 2001, provisional application No. 60/309,162, filed on Aug. 2, 2001, and provisional application No. 60/303,803, filed on Jul. 10, 2001.

(51) Int. Cl.[7] ..... B41F 27/06

(52) U.S. Cl. ..... 101/376; 101/375

(58) Field of Search ..... 101/376, 375, 101/379, 401.1, 368, 217

(56) References Cited

U.S. PATENT DOCUMENTS

| | | | | | |
|---|---|---|---|---|---|
| 4,002,777 | A | * | 1/1977 | Juvinall et al. | 427/483 |
| 5,553,541 | A | * | 9/1996 | Vrotacoe et al. | 101/217 |
| 5,934,192 | A | * | 8/1999 | Ogita et al. | 101/217 |
| 5,947,392 | A | * | 9/1999 | Molnar et al. | 239/690 |
| 6,382,102 | B1 | * | 5/2002 | Herrmann et al. | 101/376 |

* cited by examiner

*Primary Examiner*—Anthony H. Nguyen
(74) *Attorney, Agent, or Firm*—Dougherty, Clements & Hofer

(57) ABSTRACT

A printing blanket is constructed by electrostatically spraying one or more solvated elastomers onto a sleeve structure. A printing blanket can therefore having a sleeve and at least one layer, said layer comprising first and second compositions that are distinct from one another, wherein the boundary between the compositions is a gradient extending at least 0.002 inches. Another aspect of the invention relates to a method of electrostatically spraying elastomeric material onto printing blankets.

8 Claims, 1 Drawing Sheet

SPRAY COATING METHOD OF PRODUCING PRINTING BLANKETS

CROSS-REFERENCE TO RELATED APPLICATION

This application cites priority to U.S. Provisional Patent Application Nos. 60/303,803, filed Jul. 10, 2001; 60/309,162 filed Aug. 2, 2001, and 60/309,205 filed Aug. 2, 2001, the entire disclosures of which are hereby incorporated by express reference hereto.

FIELD OF THE INVENTION

The present invention relates to a printing blanket. In one application this application relates to a printing blanket including a replaceable sleeve which may be readily mounted onto a cylindrical carrier, for example a replaceable sleeve covered with a multilayer composite. This invention relates to a method of applying a layer to a printing blanket where the layer is applied by electrostatic spraying. In a preferred embodiment, a compressible rubber formulation of relatively thick cross-section is deposited on a printing blanket by an electrostatic material spray process.

BACKGROUND OF THE INVENTION

Rubber-covered cylindrical rollers are widely used in industry for a number of applications, particularly for web or sheet handling and processing applications such as the embossing, calendering, laminating, printing and coating of paper, film, foil, and other materials. In addition to their use in web processing equipment, such rubber-covered rollers are often employed in conveyors and various office machines. Such rollers are typically comprised of a cylindrical (metal) core or other support with an outer covering of rubber, elastomer, or polymer material. However, after extended use, the covering on the rollers wears down and must be resurfaced or replaced. This typically requires that the rollers be sent to an outside source where the old surface is ground down and a new surface is applied. This is inconvenient and expensive as it requires that the processing equipment be shut down while the roller is being resurfaced or that the end user stock additional replacement rollers.

The printing industry uses a device called printing blankets to, for example, transfer ink from a device to a substrate, say paper. In one embodiment this is termed off-set printing. Rubber-covered cylindrical rollers are widely used in industry for a number of applications, particularly for web or sheet handling and processing applications such as the embossing, calendering, laminating, printing and coating of paper, film, foil, and other materials. In addition to their use in web processing equipment, such rubber-covered rollers are often employed in conveyors and various office machines. Such rollers are typically comprised of a cylindrical (metal) core or other support with an outer covering of rubber, elastomer, or polymer material. However, after extended use, the covering on the rollers wears down and must be resurfaced or replaced. This typically requires that the rollers be sent to an outside source where the old surface is ground down and a new surface is applied. This is inconvenient and expensive as it requires that the processing equipment be shut down while the roller is being resurfaced or that the end user stock additional replacement rollers.

Cylindrical rollers are widely used in the printing industry. For example, printing rollers or sleeves are used in the flexographic printing industry and in the offset printing industry for providing a mountable surface for flexographic printing plates or offset printing blankets. In a typical flexographic printing press, the sleeve is mounted onto a printing cylinder using pressurized air to expand the sleeve, and the printing plates are then attached to the outer surface of the sleeve. In an offset printing process, the blanket is mounted onto a printing cylinder using pressurized air to expand the blanket.

The prior art for preparing a compressible layer for a printing blanket, as discussed in U.S. Pat. No. 5,553,541, utilizes threads as a carrier for the rubber composition and the entrapped microcells. Microspheres from are available commercially from EXPANCEL Inc., an AKZO NOBEL Co., Duluth, Ga. USA. The thickness of the prior art compressible layer is by the number of threads wound and is determined by the coating of threads of different thicknesses. The threads act as a carrier for the compressible microcellular rubber formulation, and form a partially inelastic layer of different physical characteristics than the remaining portion of the layers in the blanket. The threads are wound under tension, and the deposited layer typically stratifies to a thread-rich inner portion and a thread-poor outer portion. The use of threads is expensive and time consuming. Additionally, we have found that the presence of threads close below the face layer of the printing blanket may cause print imperfections due to a variation in pressure points. The apex of the threads applies more pressure to the printed surface then the area where two threads meet and adjoin each other, and the inelastic nature of the threads appears to result in standing waves formed where a cylindrical printing blanket which a substantially inelastic layer, for example a thread layer, contacts the substrate.

While not used commercially, U.S. Pat. Nos. 5,323,702 and 5,553,541 describe applying a compressible layer by metering with a doctor roll, a doctor blade, or by conventional spraying. Applicants have found that conventional spraying results in 1) too thin a layer being deposited, such that many tens of layers must be sprayed to achieve the desired thickness, 2) too thick a layer is deposited, resulting in solvent inclusions that form rogue cells which impair blanket performance, or 3) both.

U.S. Pat. Nos. 4,430,406, 5,035,950, and 5,474,850, the disclosures of which are incorporated herein, describe spraying a coating on a cylindrical object to form a thin, even coating useful for a fuser member.

Printing blankets must follow every exact standards in terms of thickness, wettability, expandability when mounting, compressibility, an heat generation. The one test which incorporates one or more of those parameters is a test known as compliancy, which is known to those of skill in the art. Prior art blankets have a compliancy of between about 36 and 52, where the higher the number is the less a blanket is able to absorb an impact with multiple sheets of paper which may accidently be fed into the machine. The blanket thickness is generally in the range of 0.06 inches, and a paper may have a thickness of 0.007 inches. If multiple pieces of paper are drawn into a printer, the blanket is severely shocked, and the higher the compliancy value, the more of a shock is transmitted to the printer. Too low a compliancy, however, has been associated with poor print quality.

What is needed is a method of depositing a layer on a printing blanket assembly which does not result in commercially unacceptable rogue cells. What is also needed is a commercially acceptable method of manufacturing a printing blanket without threads or other substantially inelastic layer. Alternatively, what is needed is a commercially acceptable method of manufacturing a printing blanket without threads but with a thin substantially inelastic layer. What is also needed is a blanket with a lower compliancy that has acceptable print characteristics. The present invention in its many embodiments meets these needs.

SUMMARY OF THE INVENTION

The invention comprises forming printing blankets by electrostatically spraying on at least one of a compressible layer, a reinforcing layer, or a printing face layer. In a preferred embodiment the compressible layer is applied by sequential electrostatic spraying of layers.

The invention comprises a printing blanket comprising a sleeve and at least one layer, said layer comprising a first and second compositions that are distinct from one another, wherein the boundary between the compositions is a gradient extending at least 0.002 inches, for example about 0.004 inches, in some embodiments as much as 0.02 inches, and wherein the composition within the gradient comprises a mixture of the a first composition and a second composition, wherein the first composition is different than the second composition.

In one aspect of the invention, the printing blanket is in the form of a seamless cylinder, and wherein a gradient extends radially.

The invention includes an electrostatic method of spraying a layer on a gapped or gapless tubular blanket or components which will be formulated into gapped or gapless printing blankets. This layer can include a compressible layer, a non-compressible layer which may be a reinforcing layer and/or a printing layer, an adhesive layer, or a combination thereof. In one embodiment, this blanket can include a substantially inelastic layer, for example a thin Mylar or other substantially inelastic layer, wound in a axial manner around the blanket. In a preferred embodiment, the Mylar or other strong film layer has a thickness, compared to less than the length of the printing blanket, such that a plurality of windings, for example in a "barber pole" manner, are would axially around the printing blanket. In another embodiment, the film is substantially as thick as the printing blanket length, such that a single winding of the film will cover the blanket, and the resulting gap between opposing ends of the film is sealed. The film may contain a elastomer attached thereon, or alternatively, a elastomer layer may be applied over the film, or alternatively, a combination of these processes may be used. Advantageously, if a layer is applied over the film, the layer is electrostatically applied to the outside of the film. It may be advantageous to add aditives to the film to make the film more thermally conductive, more electrically conductive, or both.

A problem with spray coating a layer in the prior art is the formation of rogue cells. The amount of solvent needed to solubilize the elastomeric base was such that pockets of solvent would be trapped during spraying. Attempts to address this resulted in extremely thin layers were put down and the solvent removed between layers. This resulted in a commercially unacceptable process.

With electrostatic spray, the formulation may be more concentrated than is used for normal spray techniques. By more concentrated the solvated elastomer contains at least 10%, preferably at least 15% of elastomer by weight. Additionally, applicants have discovered electrostatic spray reduces the formation of rogue cells even with higher loading per pass, thereby reducing the time needed to spray a layer.

A further embodiment shows the blanket is in the form of a seamless cylinder, and the gradient extends radially at least about 0.004 inches, in some embodiments as much as 0.04 inches.

A preferred embodiment shows at least one layer is a compressible layer that includes microcells, and the gradient comprises a continuous change in the concentration of microcells, wherein the gradient extends at least 0.004 inches.

A second problem with spraying a compressible layer is finding a solvent which does not prematurely attack the void-creating material in the compressible layer. This layer may contain blowing agents and the like, but a preferred material to form voids of uniform shape and which are substantially isolated from nearby voids, is the use of polymeric expandable cells, also termed microcells. It was not known in the art that microcell-containing elastomers could be sprayed onto a printing blanket and provide the necessary distribution of intact microcells in the resulting layer to be useful for printing blanket applications. In fact, microcells can be incorporated into a solvated rubber composition and can be electrostatically sprayed.

One particularly advantageous aspect of the invention, the process of electrostatic spraying allows production of a printing blanket is in the form of a seamless cylinder wherein a gradient extends radially. A further embodiment shows the blanket is in the form of a seamless cylinder, and the gradient extends radially at least about 0.004 inches. In one very extended gradient, the gradient extends as much as 0.04 inches.

A preferred embodiment shows at least one layer is a compressible layer that includes microcells, and the gradient comprises a continuous change in the concentration of microcells, wherein the gradient extends at least 0.004 inches.

In the preferred embodiment, the printing blanket comprises a compressible layer and a printing face, and optionally a reinforcing layer therebetween, characterized in that the boundary between the printing face and the layer below is in the form of a continuous gradient, wherein the composition of the printing face layer and the composition of the layer below are different, wherein the composition within the gradient consists essentially of a mixture of the composition of the printing face and of the layer below, and wherein the gradient extends at least 0.004 inches.

The printing blanket has one side of the gradient the concentration of microcells is between about 0 and about 1%, and wherein on the other side of the gradient the concentration of microcells is between about 1% and 10%, preferably between 3% and 6%, for example between about 3% and about 5%.

In the preferred embodiment, the printing blanket comprises a compressible layer and a printing face, and optionally a reinforcing layer therebetween, characterized in that the boundary between the printing face and the layer below is in the form of a continuous gradient, wherein the composition of the printing face layer and the composition of the layer below are different, wherein the composition within the gradient consists essentially of a mixture of the composition of the printing face and of the layer below, and wherein the gradient extends at least 0.004 inches.

In a further preferred embodiment, a cylindrical printing blanket comprising a sleeve, a compressible layer, and a printing face, wherein the compressible layer contains microcells to provide compressibility, and wherein the concentration of microcells in the compressible layer varies axially. In this embodiment, the compressible layer is advantageously not tapered.

In an additional preferred embodiment, a cylindrical printing blanket having a sleeve, a compressible layer, a reinforcing layer, and a printing face layer, wherein there is no thread or fiber exterior to the sleeve which extends around the sleeve in the portion of the printing blanket used for printing, and wherein at least one of the compressible layer or the reinforcing layer includes an axially oriented gradient, said gradient being either in thickness, in composition, or both.

The cylindrical printing blanket comprises a gradient which is in the compressible layer compostion. The gradient can be in the compressible layer thickness, is in the reinforcing layer composition, and in the compressible layer composition.

In a further preferred embodiment, the cylindrical printing blanket has the boundary between either the compressible layer and the reinforcing layer, the boundary between the reinforcing layer and the printing face layer, or both boundaries, includes a compositional gradient extending at least 0.004 inches radially, and wherein the composition within the radial gradient comprises a mixture of the a compositions of the layers adjoining the boundary, wherein the compositions of the adjoining layers are different.

Additionally, the boundary containing the radial gradient is between the compressible layer and the reinforcing layer, is between the reinforcing layer and the printing face layer, and is on the boundary between the reinforcing layer and the compressible layer, the compressible layer comprising porosity, and wherein the composition gradient comprises a decrease in the porosity from the porosity of the compressible layer to the lower porosity of the reinforcing layer.

In another preferred embodiment, in the cylindrical printing blanket the porosity comprises microcells. Further, in one embodiment the solvated rubber composition comprises unexpanded microcells, expanded microcells, or both. There are grades of EXPANCEL® microspheres available with expansion temperatures in the range of 80–190° C. (176–374° F.). The different EXPANCEL® microsphere grades vary according to: expansion factor; heat resistance; particle size; and chemical and solvent resistance. The expansion when heated is due to a small amount of a hydrocarbon encapsulated by a gastight thermoplastic shell. When the microspheres are heated the thermoplastic shell softens and the hydrocarbon inside the shell increases its pressure. This results in a expansion of the spheres (typical diameter values: from 10 to 40 $\mu$m). See http://www.expancel.com/product/index.htm for other information on these microcells. See, for example, http://www.expancel.com/product/files/prod%20spec%20wu.pdf for information on the solvent resistance of various grades of microcells.

In still a further preferred embodiment, a method for adding a layer to a multilayer printing blanket comprising the steps of providing a sleeve, applying a compressible layer disposed exterior to the sleeve, optionally applying a reinforcing layer disposed exterior to the compressible layer, applying a printing face layer about the screen, wherein at least one of the applying the compressible layer, the reinforcing layer, or the printing face layer is performed by electrostatic spray application of an electrically charged solvated rubber composition, wherein the voltage of the spray is at least about 500 Volts different than the voltage of the printing blanket. A preferred method of spraying, called Ransberg electrospraying, is described in U.S. Pat. No 4,002,777, the disclosure of which is incorporated herein by reference.

As described in U.S. Pat. No. 4,356,528, the disclosure of which is incorporated here by reference, paint-spraying has for many years been carried out by means of sprayers which impart an electrostatic charge to the paint spray particles. Electrostatic paint-spraying has a number of advantages. The charged particles are attracted to the object being sprayed, and thus less are wasted; the electrostatic field promotes adhesion and even coating; moreover the field carries particles round behind the object, to coat the back of it. Apparatus used in electrostatic paint-spraying has been of two types, both associated with the name of Ransburg. In the earliest apparatus, paint was atomised from a conventional nozzle, and passed through a wire grid mesh, held at a potential of the order of 100,000 volts. This charged the paint spray by ionic bombardment. In a subsequent development, paint was supplied to a rotating disc, from the edges of which it atomised as charged particles under the influence of a high potential (usually about 70,000–80,000 volts) applied to the disc. First introduced in the 1940's, electrostatic paint-spraying machines are in widespread use today.

One advantage of electrostatic spray is the possibility to have the composition contain a high loading of elastomer in the solvents. As described in U.S. Pat. No. 5,034,154, the disclosure of which is incorporated here by reference, typically high solvent concentrations are required with high molecular weight resins in order to supply flowability and other properties necessary for ease in applying a uniform coating. Due to strict air pollution regulations, pollution abatement of solvents is of paramount importance. To this end, the industry has expended much effort in an attempt to develop electrostatically sprayable coatings containing high solids contents; that is, coatings having a lower amount of solvents in order to satisfy pollution regulations. Attempts to achieve high solids coatings by merely using more of the conventional high molecular weight resins in the coatings have not been successful since the increased solids content using these resins results in an unacceptably high viscosity, and often the larger amounts of the resins cannot themselves be dissolved. One approach is to formulate coatings containing low molecular weight resins (e.g., of about 1,000 to 7,000 weight average molecular weight) in high solids coatings in order to reduce the amount of solvents necessary in the blending for coating applications and, hence, the pollution difficulties associated with the solvents themselves.

K. K. Mitra, "Electrostatic Application of Paint", Paint India, vol. 29, no. 9, pp. 52–56 (1979) indicates that while non-polar solvents (aliphatic and aromatic hydrocarbons chlorinated solvents, terpenes, etc.) can be employed in electrostatically sprayable paints to increase bulk and resistivity, polar solvents are used to control resistivity. The polar group is said to include ketones, alcohols, esters, ethers, ether alcohols, and nitro paraffins, etc. The non-polar group is said to include aliphatic and aromatic hydrocarbons, chlorinated solvents, terpenes, etc. Also illustrative of prior art, high solids acrylic resins are those disclosed in U.S. Pat. No. 4,276,212 and in European Patent Applications 27,719; 29,594 and 29,683. Solvents which are indicated to be typical in these references (e.g., those mentioned in European Patent Application 29,594) are: Toluene, xylene, butyl acetate, acetone, methyl isobutyl ketone, methyl amyl ketone, methyl ethyl ketone, butyl alcohol and other aliphatic, cycloaliphatic and aromatic hydrocarbons, esters, ethers, ketones, and alcohols.

The organic solvents which can be employed in electrostatic spraying of a layer on a printing blanket include at least one member selected from the group consisting of ketones, ethers, glycols, glycol ethers, esters, keto ethers, ether esters, alcohols, nitrosubstituted paraffins, aromatic solvents and halocarbon solvents. Exemplary ester solvents are butyl acetates, pentyl acetates, hexyl acetates, pentyl propionates, isobutyl isobutyrate, heptyl acetates, methyl pentanoates, ethyl pentanoates, pentyl pentanoates, ethyl hexanoates, butyl hexanoates, ethyl neopentanoate, methyl neoheptanoate, octyl acetates, nonyl nonyl acetates, decyl acetates, undecyl acetates, acetates, dodecyl acetates, tridecyl acetates and the like. Exemplary of esters wherein the carboxylic acid moiety is derived from an ether-containing-containing acid (e.g., acids which are alkoxy-substituted) are ethyl 3-ethyoxypropionate, butyl 3-butoxypropionate, methyl 2-methoxyacetate, methyl 3-methoxypropionate, propyl 3-propoxypropionate and the like. Suitable ketone solvents include methyl amyl ketone, methyl isobutyl ketone, methyl propyl ketone, isophorone, cyclohexanone, diethyl ketone, dibutyl ketone, methyl isopropyl ketone, methyl sec-butylketone, benzophenone, mixtures thereof, and the like. Suitable ether solvents include dibutyl ether, tetrahydrofuran, anisole, dioctyl ether, 1,2-dimethoxyethane, 1,4-dimethoxybutane. Suitable halocarbon solvents include 1,1,2-trichloroethane, tetrachloroethane and the like. Suitable nitroparaffinic solvents include nitropropane and nitropentane. Suitable alcohols include 2-ethyl hexanol, diacetone alcohol, n-butyl alcohol, phenethyl alcohol, benzyl alcohol, amyl alcohol, isobutyl alcohol, tertiary butyl alcohol, hexyl alcohols, and the like. Suitable glycol ethers, esters and mixed ether and ester solvents include ethylene glycol diacetate and propylene glycol diacetate. Of course, the solvent composition can be a mixture of any of these components.

Supercritical solvents and/or compressed fluids may when used as part of the solvent system provide improved atomization of droplets. See, for example, U.S. Pat. Nos. 5,464,154 and 5,290,603, the disclosures of which are incorporated here by reference, describing the use of carbon dioxide, ethane, or nitrous oxide to obtain high solids loading with finer atomization. Compounds which may be used as compressed fluids in the present invention include but are not limited to carbon dioxide, nitrous oxide, ammonia, xenon, ethane, ethylene, propane, propylene, butane, isobutane, chlorotrifluoromethane, monofluoromethane, and mixtures thereof.

In some embodiments the solvent may comprise water. In general, up to about 30 percent by weight of water, preferably up to about 20 percent by weight, may also be present in a solvent portion comprising organic solvent, provided that a coupling solvent is also present. A coupling solvent is a solvent in which the nonvolatile materials such as polymers are at least partially soluble. Most importantly, however, such a coupling solvent is also at least partially miscible with water. Thus, the coupling solvent enables the miscibility of the nonvolatile materials, the solvent, and the water to the extent that a single liquid phase is desirably maintained such that the composition may optimally be sprayed.

The coupling solvent also enables miscibility with, for example compressed fluid. Coupling solvents are well known to those skilled in the art of coatings and any conventional coupling solvents which are able to meet the aforementioned characteristics are suitable for being used in the present invention. Applicable coupling solvents include, but are not limited to, ethylene glycol ethers, propylene glycol ethers, and chemical and physical combinations thereof; lactams; cyclic ureas; and the like. When water is not present in the polymeric composition, a coupling solvent is not necessary, but may still be employed. Other solvents which may be present in typical polymeric compositions, including coating compositions and the like, and which may be utilized in the present invention include ketones such as acetone, methyl ethyl ketone, methyl isobutyl ketone, methyl amyl ketone, cyclohexanone and other aliphatic ketones; esters such as methyl acetate, ethyl acetate, and other alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, butanol, amyl alcohol and other aliphatic alcohols; aromatic hydrocarbons such as toluene, xylene, and other aromatics or mixtures of aromatic solvents; aliphatic hydrocarbons such as naphtha and mineral spirits, and other aliphatics or mixtures of aliphatics; and nitroalkanes such as 2-nitropropane.

Of course, the material in other layers may be applied by other methods, such as with conventional spraying, dipping, painting, or other methods, but in a preferred embodiment both the compressible layer and the printing face layer are electrostatically sprayed.

A preferred embodiment also discloses the method wherein the voltage difference is between about 1000 and 70,000 volts, the voltage difference is between about 10,000 and 40,000 volts, and the voltage difference is between about 10,000 and 40,000 volts. A apparatus for dispensing the solvated elastomer composition can be found in, for example, U.S. Pat. Nos. 5,044,564, 5,271,569, 5,685,482, and 6,056,215, the disclosures of which are incorporated herein by reference.

Additionally, the method includes the application of the charged solvated rubber composition which forms an electrical current with a density between about 0.05 to about 4.0 milliamps per spray head, and comprises butyl rubber, nitrile rubber, EPDM rubber, natural rubber, synthetic rubber, neoprene rubber, polysulfide rubber, a blend of nitrile rubber and polyvinyl chloride, polyurethane, or mixtures thereof.

In the preferred embodiment, the method includes the solvated rubber comprises nitrile-butadiene copolymer, hydrogenated nitrile-butadiene copolymer, carboxylated nitrile-butadiene copolymer, nitrile-butadiene-isoprene terpolymers, neoprene, isoprene, epoxidized isoprene, SBR, a polyurethane elastomeric rubber, or blends thereof, and a chemical blowing agent, expanded or unexpanded microcells, mixture thereof.

The preferred embodiment includes a method wherein the electrostatically sprayed layer is the printing face layer, and the solvated rubber composition comprises nitrile-butadiene copolymer, hydrogenated nitrile-butadiene copolymer, carboxylated nitrile-butadiene copolymer, nitrile-butadiene-isoprene terpolymers, neoprene, isoprene, epoxidized isoprene, SBR, EPDM, butyl, halogenated butyl, fluoroelastomers, polyurethane elastomeric rubber, or blends thereof.

The elastomeric compositions must be dissolved or suspended in solvent to be effectively electrostatically sprayed. Any polar solvent or mixture of solvents that can solubilize the elastomer, carry a current, and not attack the microcells will work, but a solvent with a composition R1—CO—O—R2 is a preferred solvent, where R1 and R2 are independently a C1 to C6 hydrocarbon or an aromatic moiety.

T-butyl acetate is a good solvent for most polymers such as acrylics, polyesters, polyethers, polyurethanes and is compatible with many solvents and other constituents that are typically used in coating compositions. In particular, t-butyl acetate is readily volatilized at ambient temperatures and above and coatings formulated therewith dry rapidly. Up to 50% by weight of other compatible solvents can be such as glycol ethers such as n-propoxy propanol, alcohols such as methanol, ethanol, isopropanol, butanol, and high molecular weight esters such as 2-ethyl hexyl acetate. By compatible is meant solvents that will blend with tertiary butyl acetate and will be a solvent for the rubber composition.

Preferably, the solvent or solvent mixture used as the organic liquid carrier of the coating composition will not attack the plastic substrates of the sleeve, if being applied to a polymeric sleeve, and will not attack microcells if the compressible layer is being electrostatically sprayed. The solvent or solvent mixture is selected so as to be compatible with (i.e., not unduly attack) the microcells, fibers, or other solid or polymeric additives, and/or the polymeric sleeve, if any of these exist in the sprayed composition or on the substrate.

In one embodiment the solvent further comprises polymerizable low-molecular weight monomers, dimers, and/or compounds such as glycols. In another embodiment the solvent further comprises crosslinkers, vulcanizing agents, or the like.

Of course, the elastomer can be admixed with a first solvent to provide a flowable material, and then admixed with at least one more solvent immediately prior to being sprayed. The second solvent can, in some embodiments, include one or more curing agent or the like, where long term storage of the elastomer with the curing agents before application can result in pre-mature and adverse setting up of the elastomer before application onto a blanket.

Suitable solvents may include ketones such as methyl ethyl ketone, methyl isobutyl ketone, methyl amyl ketone, 1,4 pentanedione, low molecular weight esters such as ethyl acetate, hexyl acetate, the isomers of t-butyl acetate, i.e. n-butyl acetate, secondary butyl acetate and isobutyl acetate; and aromatic hydrocarbons such as toluene and xylene.

The preferred embodiment method comprises the solvent which comprises methyl isobutyl ketone, or ethyl acetate and a ketone, at between about 5% to about 50% methyl amyl ketone, methyl isobutyl ketone, and between about 10% to about 30% solids, and the solvated rubber is applied in layers that are between about 0.001 inches to about 0.005 inches thick after drying.

It is known that electrostatic spraying involves movement of charged particles, and therefore forms a small but non-zero current. Therefore, the blanket substrate must be at least partially conductive. In one embodiment, if the sleeve is not metal, the sleeve has incorporated therein or thereon conductive fibers, for example carbon fiber, or minerals, for example silicates, aluminosilicates, or the like, to help distribute the electrostatic charge more evenly about the sleeve. In flat blankets that typically have a fabric substrate, or in cylindrical blankets made of flat preformed components sprayed on for example a film ribbon or a film intended to be wrapped about a sleeve, it is often advantageous to incorporate conductive fibers or minerals within or disposed near to the fabric substrate or film. Of course, the blanket fabric substrate or film may in a less preferred method may be placed against a conductive backing.

In another embodiment, the invention comprises electrostatic spraying of a flat sheet. This flat sheet can be a flat printing blanket, or can be a component formed into a gapless or gapped printing blanket. For example, the compressible layer, the reinforcing layer, and/or the print layer may be formed in separate forming stations using an electrostatic spray deposition process onto a ribbon, and the ribbon can then be wrapped around the circular blanket, either in a once-around wrap with a gapped blanket, or as a ribbon which is wrapped barber-pole style to give a blanket more similar to a gapless blanket. The amount of sprayed-on layer can be controlled so that the wrapping may be one, two, or three layers. In each case, the partially overlapping strips of reinforcing material are preferably bonded to each other with an adhesive. To effectively electrostatically spray such a layer, especially in the application for flat blankets, one issue that exists is that there must be a conductive material in order to ensure a proper adhesion.

Currently, flat blanket technology uses polyester, cotton and/or rayon as the substrate. In one embodiment a conductive fiber component, such as carbon fibers and/or carbon black, is introduced into in the textile fabrics to overcome this issue. U.S. Pat. No. 6,056,215, the disclosure of which is incorporated herein by reference, describes a method of electrostatically spraying onto a substrate containing carbon fiber. Alternatively, conductive clays or the like may be bonded to the fibers to increase conductivity. In yet another embodiment, ionic functional groups can be grafted to the fibers in an amount sufficient to contribute to the required conductivity or to more effectively hold the conductive material in place. Or, a combination of methods may be used.

Additionally, it may be advisable to increase the thermal conductivity of one or more layers. This can be done by adding, for example, thermally conductive material such as aluminum oxide or iron oxide. Such material must be positioned and of a size such that the particles do not substantially affect the print quality.

DETAILED DESCRIPTION OF THE PREFERRED EMBODIMENTS

Figure 1:
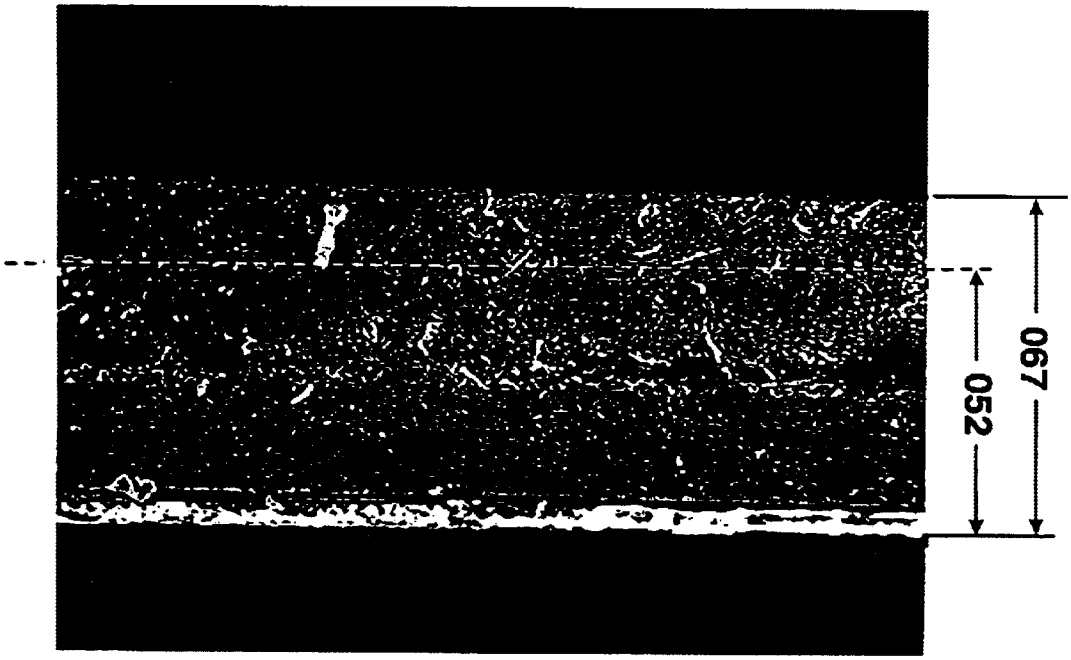
FIG. 1, the dingle figure in this case, is a photomicrograph of a cross-section of a printing blanket having sprayed layers thereon, in accordance with the invention.

The present invention is related to several other co-pending applications, namely U.S. patent application No. 10/101/185, entitled "Printing Face Formulary," filed on even date herewith and itself claiming priority to U.S. Provisional Patent Application No. 60/303,767, filed Jul. 10, 2001; U.S. Patent Application No. 60/303,804, entitled "Polymeric Sleeve Used in Printing Blanket," filed on even date herewith and itself claiming priority to U.S. Provisional Patent Application No. 60/303,804, filed Jul. 10, 2001; and U.S. Patent Application No. 60/303,818 entitled "Printing Blanket Face and Compressible Layer Compositions," filed on even date herewith and itself claiming priority to U.S. Provisional Patent Application No. 60/303,818, filed Jul. 10, 2001, each of the entire disclosures of which are hereby incorporated herein by express reference hereto.

The invention relates to applying a primer, a compressible layer, a reinforcing layer, and/or a printing face layer by encasing the material to be sprayed in an appropriate solvent or solvents and electrostatically spraying the composition onto the printing blanket assembly.

According to one aspect of the present invention, a replaceable blanket is provided which is adapted to be mounted on a carrier. By carrier, we mean any structure which functions to support the sleeve during use and allows it to rotate during use including but not limited to cylinders, tubes, and liners. The replaceable blanket is made up of a combination of layers including an inner sleeve, optionally a reinforcing layer overlying the inner sleeve, an intermediate compressible polymeric layer overlying sleeve/reinforcing layer, optionally a reinforcing layer overlying the compressible layer, and an outer polymeric layer forming a working, i.e., printing, surface.

The electrostatic spraying utilizes an electrical charge applied to a spray particle in an amount between about 500 and about 100,000 volts, preferably between about 1,000 and about 70,000 volts, more preferably between about 10,000–40,000 volts, where the voltage is the differential between the charged solvated rubber particle and the substrate. While either direction of charge is possible, beneficially the spray particles are positively charged and the substrate is negatively connected to ground. The voltage of the spray electrode required for optimum substance transfer depends on how far away from the substance transfer region the spray is charged. If the spray electrode is positioned very near to the substance transfer regions about 2000 V may be required. The optimum positioning of the spray electrode and the optimum setting of the spray-electrode voltage can be carried out without difficulty by a person skilled in the art.

The substrate can be either metallic or non-metallic, i.e., polymeric. While primed thin metal sleeves have been employed in the past, more recently, printing sleeves have been developed which are comprised of polymeric materials. For example, printing sleeves are known which include laminated polymeric layers reinforced with a woven or nonwoven fabric layer. Such sleeves provide an advantage over metal rollers in that they are readily expandable for mounting on a cylinder, are seamless, and provide good structural integrity for printing operations without the damage and safety limitations of thin metal sleeves. The sleeve may have a reinforcing layer, and may have a coating or layer on the internal diameter to provide the desired friction or holding strength to the roller. The substrate can be either a sleeve, a primed sleeve, or a sleeve with one or more coatings affixed thereto.

It is known that electrostatic spraying involves movement of charged particles, and therefore forms a small but non-zero current. Therefore, the blanket substrate must be somewhat conductive. In one embodiment, if the sleeve is not metal, the sleeve has incorporated therein or thereon conductive fibers, for example carbon fiber, or minerals, for example silicates, aluminosilicates, or the like, to help distribute the electrostatic charge more evenly about the sleeve. Alternatively, these conductive materials may be incorporated into a fabric or theread or film wrapped around the sleeve.

In flat blankets that typically have a fabric substrate, or in cylindrical blankets made of flat preformed components sprayed on for example a film ribbon or a film intended to be wrapped about a sleeve, it is often advantageous to incorporate conductive fibers or minerals within or disposed near to the fabric substrate or film. Of course, the blanket fabric substrate or film may in a less preferred method may be placed against a conductive backing.

While not being bound by theory, it is believed that the electrostatic forces attract the solvated rubber particles in a uniform manner. One of the principle advantages of this phenomena is that a circular object, i.e., a cylindrical printing blanket, can be uniformly coated with a minimum of waste and overspray. Further, the electrostatic spray technology reduces the amount of volatile organic compounds (VOCs). There is less over-spray, and the use of electrostatic spray techniques allows the use of solutions with much higher fraction of link solid material, i.e., rubber and optionally microcells or other inclusions, versus conventional air or airless spray techniques of the prior art. The use of electrostatic spray techniques also provides better atomization, i.e., size control of the individual spray particles because positively charged particles repel on another and therefore do not coalesce in the air prior to reaching the substrate. The electrostatic spraying technique with the properly formulated solvent system prevents agglomeration of individual spray particles until the particles reach the substrate. This technique prevents undesired spray conditions such as "clumping", lumping, spitting etc. Thus relatively large rogue cells, i.e. large holes formed due to solvent entrapment, are virtually eliminated. Rogue cells are a problem with traditional coating processes using knife blades, doctor rolls, or traditional spraying techniques, and is the principle reason such techniques are not used commercially. Rogue cells provide unacceptable print quality and drastically shorten a blankets useful life.

The movement of charged particles to the substrate creates an electrical current. It is preferred to have this current be between about 0.05 to about 4.0 milliamps (ma), more preferred between about 0.1 ma to about 1.5 ma, most preferred between about 0.2 ma to about 0.8 ma, per spray head.

In one embodiment, there are a plurality of sleeve substrates within a painting booth. A conveyor system exposes at least one sleeve substrate to a stream of charged atomized solvated rubber particles. A spray-forming nozzle, for example a high speed spinning disk sprayer, advantageously moves up and down while the sleeves or substrates move through the spray booth, thereby affecting total coverage and a very high efficiency of spray solution while apply a very uniform and consistent spray coating of material to each substrate in a continuous process and minimizing material waste. Note that overspray may be attracted to and adhere to other grounded printing blankets, so waste is substantially eliminated.

Preferably, the inner layer, intermediate layer, and outer layer are comprised of an elastomeric material selected from, but not limited to, the group consisting of butyl rubber, nitrile rubber, EPDM rubber, natural rubber, synthetic rubber, neoprene rubber, polysulfide rubber, a blend of nitrile rubber and polyvinyl chloride, polyurethane, and mixtures thereof.

The compressible or cushion layer functions to provide energy absorption and resiliency to the blanket while allowing strain deformations to occur in the radial direction with little to no Poisson's effect occurring at the printing interface. This radial compressibility is needed to keep the printing within the required specs. The compressible layer may comprise of an open or closed-cell polymeric foam.

In one embodiment, this compressible layer comprises a composition formed from a nitrile-butadiene coplymer, hydrogenated nitrile-butadiene copolymer, carboxylated nitrile-butadiene copolymer, nitrile-butadiene-isoprene terpolymers, neoprene, isoprene, epoxidized isoprene, SBR, or any of the polyurethane elastomeric rubbers, or blends of such. The cell structure of the compressible layer may be created with suitable chemical blowing agents such as magnesium sulfate, hydrated salts, hydrazides such as p-toluene sulfonyl hydrazide and p,poxybisbenzene sulfonyl hydrazide, and carbonamides such as 1,1'-azobisformamide, nitrate, nitrite, bicarbonate and carbonate salts. Still another preferred method of forming the compressible layer includes the incorporation of microcapsules, for example microcells.

In another embodiment, a compressible layer is applied to a sleeve, and to optionally a reinforcing layer, comprises a non-thread polymeric layer consisting of a nitrile-butadiene coplymer, hydrogenated nitrile-butadiene copolymer, carboxylated nitrile-butadiene copolymer, nitrile-butadiene-isoprene terpolymers, neoprene, isoprene, epoxidized isoprene, SBR, or any of the polyurethane elastomeric rubbers, or blends of such. The reinforcing layer may be disposed above, below, or bot above and below the compressible layer, and advantageously is applied by electrostatic spraying. The reinforcing layer is designed in composition, via polymeric composition or reduction in cell density versus the compressible layer, to posses physical properties of higher hardness, static modulus, dynamic modulus as compared to the compressible layer.

The compressible layer in some embodiments benefits from and is structurally strengthened by the addition of the reinforcing layer. Like the compressible layer, the solvated polymeric and/or rubber components and any fillers are beneficially applied to the printing blanket by electrostatic or by less preferred conventional spraying.

In one embodiment the transition between one layer and the next is made gradually, for example by having two feed lines to the spray nozzle where the relative fractions of each feed line can be changed, either abruptly of preferably gradually. Alternatively, there can be a mixing chamber with acts like a classical continuously stirred tank mixer, where the input into the mixer can be changed from a first composition to a second composition, and the output of the mixer will be a continuous gradient from 100% of the first ingredient to 100% of the second ingredient over time. In such a system the radial extent of the gradient will depend on the capacity of the mixer. In yet another embodiment the gradient can be formed by gradually changing the feed composition between layers, where each layer is of a small thickness such that the steps substantially form a gradient. Of course, it is also possible to have a plurality of nozzles, where the relative contributions from the nozzles can be changed with time. The gradient may be gradual or may be a step function, where there is a plurality of compositional steps in the interface between layers, say, between the compressible layer and either the reinforcing layer or the printing face layer if not reinforcing layer is present.

If, for example, the solvated elastiomer to be sprayed is admixed with a second solvent which comprises a crosslinking agent, accelerator, vulcanizing agent, or the like, then quick acting and/or low temperature crosslinking agent, accelerator, vulcanizing agent, or the like can be used. Additionally, by varying the amounts of solvated rubber to solvent containing crosslinking agent, accelerator, vulcanizing agent, or the like, a gradient of stiffness or crosslinking can be made within a layer.

The solvated rubber composition may optionally include a binder capable of forming a bond with one or more particulate fillers such as barite, silica, carbon black, polysulfide rubber, microcells, and the like, such as carboxylated styrene butadiene latex, styrene-acrylic copolymer latex, acrylic latex, vinyl acrylic latex, urethane (aromatic and aliphatic), diphenylmethane diisocyanate-urethane (MDI), and toluene diisocyanate (TDI), any or all of which may be included in the elastomer composition.

Advantageously, the uncured rubber may also be formulated to contain unexpanded microspheres, pre-expanded microspheres, or a combination thereof for the compressible layer spray formulation. While many formulations for microspheres exist, various microspheres are subject to undesired degradation by selected solvents used to liquify the rubber composition. The person of ordinary skill in the art with the benefit of this disclosure can select a solvent or mixture of solvents that provides the required properties—that is, a polar organic solvent which is capable of solvating the rubber composition and which does not unduly attack microsphere.

Advantageously, the uncured rubber may also be formulated to contain unexpanded microspheres, pre-expanded microspheres, or a combination thereof for the compressible layer spray formulation. Such microspheres are subject to undesired degradation by solvents used to liquify the rubber composition. One preferred embodiment uses a solvent Methyl Isobutyl Ketone, MIBK. In another embodiment the solvent comprises a mixture of Toluene, Ethyl Acetate and a Ketone. In a third embodiment, the solvent comprises a mixture of between 5% to 50% Methyl Amyl Ketone, preferably 10%–30%, more preferably 18%–25% it, where the balance is substantially MIBK. Of course, any polar organic solvent which is capable of solvating the rubber composition and which does not unduly attack microsphere can be used, especially in combination with MIBK and/or methyl amyl ketone.

The applicants have surprisingly found that the spray technique applies microspheres in a cost efficient technically very uniform and desired random manner. Microspheres are generally incorporated into a compressible layer spray matrix. The spray device can disperse both expanded and unexpanded microspheres in a solvated rubber composition without undue loss, i.e., with less than about 20% loss, of microspheres. The spray particles are advantageously sized to have a diameter of 10 times or less the average diameter of the microspheres. A typical microsphere has a diameter of about 15 to 60 microns.

In yet another embodiment the spray formulation is adapted to provide, at least in the compressible layer, a rubber matrix that consists of sprayed-on particles that adhere to the substrate, wherein the sprayed-on particles maintain some structure after spraying such that a natural porosity is formed between adjacent sprayed-on particles.

The solvent preferably does not to insulate to the extent that it cannot sustain a current. For example, pure toluene is not a preferred solvent because it is difficult to establish the required current density.

Solvents such as MEK and acetone are not preferred because the have a tendency to chemically attack and dissolve the Expancel 461DE compressible microspheres, a preferred microsphere available from Expancel. Additionally, these solvents when used in substantially pure form can conduct too much charge for a safe spray operation not prone to fire or explosion.

The solvated rubber composition has between 3.0%–50% solids, more preferably about 10% to about 30% solids, most preferably 13%–22%, with the balance solvent. One advantage to electrostatic spraying is that solid loading can be greater than for traditional spraying. Electostatic forces bring solvated rubber spray particles to the surface, and the solvent wetting ability of the substrate surface is less a factor in holding solvated rubber to the substrate. This higher solids loading means fewer passes will have to be performed to achieve a desired thickness.

Known apparatus for use in applying electrostatically charged coating material to a workpiece is disclosed in for example U.S. Pat. Nos. 3,746,254; 3,794,243; 5,271,569; 5,538,186; and 6,021,925. The spray delivery system, i.e., the spray nozzle, can be any device capable of dispensing small charged particles, and is preferably an electrically charged spinning disc, spinning for example at 2000 rpm. Such a disc is well adapted to generating small charged particles. The disc may be moved, and/or sleeve may be moved and rotated as needed to expose a parallel surface to the disk and to affect full coverage.

The preferred solution delivery rate between 100–1000 g/min, most preferred 300–500 g/min, per spray nozzle.

The coatings applied can be relatively thick, for example up to 0.100 inches, without the use of a carrier material such as thread or fabric.

The spray coating thickness after drying, is beneficially between about 0.0002"–0.010" per pass, preferably between about 0.001- to about 0.005 inches per pass. The thickness of the applied rubber coat for a preferred single spray pass is therefore about 10 times the diameter of a microcell. The spray process is continuous and multiple passes can be applied until the final desired thickness is achieved the individual layers are uniformly and chemically bonded to form a singular solid matrix after drying and curing. Advantageously, the solvent is at least partially vaporized from the deposited solvated rubber between passes. In one embodiment, the solvent is substantially vaporized, such that the deposited solvated rubber composition has between about 0% to about 50%, preferably between about 0% to about 30%, more preferably between about 0% to about 10%, of the original solvent before an additional coat is applied. Solvent entrapment can coalesce and form rogue cells during subsequent treatment of the printing blanket. Eliminating some solvent between layers, coupled with electrostatic spray method of application, substantially eliminates unacceptable rogue cells.

Advantageously, the applied spray coating can be engineered to be applied as to minimize the grind to the desired final dimensional tolerance. The design of the part is not dependent on the thickness of any other carrier material such as thread or fabric.

Advantageously, the spray process can be modified to provide an axial taper to any layer, for example having the compressible layer be about 0.01 inches thicker near the center of the printing blanket. Advantageously more than one layer can be tapered, for example having a compressible layer be about 0.02 inches thicker near the center of the printing blanket as viewed axially, with the thickness tapering off either continuously (by varying the speed the spray nozzle moves relative to the blanket) or in a stepwise manner wherein the steps equal about the thickness of a sprayed-on layer.

A 100% pure compressible material layer can be prepared to virtually any desired overall thickness required and suitable for the printing application.

The electrostatic spray-on method is also applicable to forming the printing face. The printing face may include a closed-cell foam or solid density or mixture thereof. The printing face may include a nitrile-butadiene copolymer, a hydrogenated nitrile-butadiene copolymer, a carboxylated nitrile-butadiene copolymer, a nitrile-butadiene-isoprene terpolymers, neoprene, isoprene, epoxidized isoprene, SBR, EPDM, butyl, halogenated butyl, fluoroelastomers, or any of the polyurethane elastomeric rubbers, or blends thereof.

The printing face composition may also include fillers, wettability modifiers, basicity modifiers, crosslinkers, and the like. The printing face solvated rubber composition may optionally include a binder capable of forming a bond with one or more particulate fillers such as barite, silica, carbon black, polysulfide rubber, microcells, and the like, such as carboxylated styrene butadiene latex, styrene-acrylic copolymer latex, acrylic latex, vinyl acrylic latex, urethane (aromatic and aliphatic), diphenylmethane diisocyanate-urethane (MDI), and toluene diisocyanate (TDI).

The spray application method is suitable for providing threadless printing blankets. The threadless printing blanket for the gapless seamless printing blanket market includes a plurality of layers, including a substantially cylindrical sleeve, a threadless compressible layer or cushion layer, optionally a threadless reinforcing layer, and a threadless printing face layer. Threads are believed to affect print quality and create undesired pressure lines in the printing face, which transfers the ink to paper at variations in intensities. A threadless blanket would be an improvement over current and prior art for print quality.

In one embodiment, the blanket contains a high modulus/low elongation sleeve. This sleeve is typically a thin 0.003" to 0.010" nickel alloy sleeve that has been primed with one or two primers which promote adhesion of the compressible layer onto the sleeve. This invention is not limited to metallic sleeves, however, and can be applied to ant suitable high modulus/low elongation film type substrates of non-metallic and metallic structure.

The spray-on method of applying a compressible layer, a reinforcing layer, and/or a printing face layer is suitable for providing a gradient in one or more layers. This allows the individual layer or layers to have smooth concentration gradients and smoothly changing physical properties within a layer. Concentration gradients may be achieved by, for example, having a plurality of feeds lines feeding different compositions to the sprayer, wherein the relative quantity of each of the individual feeds can be controlled, and the individual feeds are substantially mixed during the spraying. This allows gradients in both a radial direction and in an axial direction.

Alternatively, the feed line may include a mixing chamber, wherein a solvated rubber composition different from the first solvated rubber composition is added to the mixing chamber, and wherein the sprayed composition reflects the average composition in the mixing chamber. For example, the mixing chamber may be initially filled with a solvated rubber composition that includes microcells in an amount similar to that used in the compressible layer. At some point during the spray process, the feed to the mixing chamber is changed to a solvated rubber composition that does not contain microcells. Depending on the size of the mixing chamber, the spray will contain a continually changing concentration that approaches zero with time. Of course, the concentration gradient can be controlled by sizing the mixing chamber. This method provides an easy method of forming radially directed gradients.

Alternatively, gradients can be formed by having a plurality of sprayer heads, wherein each sprayer head emits a different solvated rubber composition. The gradients can be formed by either having the spray heads spray an area simultaneously, wherein the throughput of individual spray heads can be controlled, or alternatively by having spray heads form discrete, very thin layers sequentially, wherein the relative number of thin layers or the relative thickness of the thin layers from each nozzle varies with distance, either radially or axially or both.

Of course, a combination of one or more of these methods may also be useful to form axial and/or radial concentration gradients.

In one embodiment, a reinforcing layer or layers may be formed with a gradient in properties which structurally strengthen printing blanket, wherein there is no discernable boundary between the compressible layer and the reinforcing layer(s). There is therefor no boundary wherein sharp differences in physical properties create stresses, heat, or locations prone to failure. In this preferred embodiment, this gradient may be designed radially to the design of the printing cylinder.

In another embodiment, the printing blanket contains a sleeve which is primed as necessary, and a single layer comprising a plurality of gradients, where a portion of the layer comprises a compressible layer and a portion of the layer comprises a printing face composition, wherein the boundaries between these layers are indiscernible or at least diffuse, the boundary is a gradient with a radial extent of at most 0.005 inches. We have found that distinct boundaries create regions of stress. Further, adhesives are often required between layers. The spray technology, and especially the electrostatic spray technology, are well suited to making a layer or layers with concentration gradients with no discernable boundary between layers, or with diffuse boundary which comprises a concentration gradient over at least about 0.002 inches, preferably at least about 0.004 inches, more preferably at least, about 0.006 inches. As used herein, the term "gradient extends a distance" means there is a substantially continuous change in the composition of the layer over that distance, such that the composition of the layer, including polymeric components of the rubber and/or fillers, differs substantially on each side of the gradient. The gradient concentration change may be linear or curved with respect to the distance the gradient encompasses.

A printing face rubber is sprayed or spreader coated or extruded, to the top of the compressible or cushion layer wherein there is no thread used.

The spray method of placing layers on a printing blanket also allows the placement of axial gradients. It is known that gross physical properties near the edge of a blanket differ during printing from blanket properties nearer the center of the blanket. For this reason the prior art has made the blanket with a taper, either a step down taper, a straight line taper, ir a curved, i.e., parabolic, taper. In one preferred embodiment the relative amounts of compressible material or other compounds varies as a gradient in an axial direction such that acceptable print quality is obtained from an offset printing blanket of the current invention that does not have a taper. This optional lateral gradient has a functional behavior, which would provide for variations in compressibility across the face of the blanket, functionally replacing the need for profile or step grinding of the compressible layer, which is an advantage to prior art.

The spray-on application method is also useful for refinishing refurbished blankets.

The elastomeric compositions must be dissolved or suspended in solvent to be effectively electrostatically sprayed. Any solvent will work, but a solvent with a composition R1—CO—O—R2 is a preferred solvent, where R1 and R2 are independently a C1 to C6 hydrocarbon or an aromatic moiety. T-butyl acetate is a good solvent for most polymers such as acrylics, polyesters, polyethers, polyurethanes and is compatible with many solvents and other constituents that are typically used in coating compositions. In particular, t-butyl acetate is readily volatilized at ambient temperatures and above and coatings formulated therewith dry rapidly. Up to 50% by weight of other compatible solvents can be used such as glycol ethers such as n-propoxy propanol, alcohols such as methanol, ethanol, isopropanol, butanol, and high molecular weight esters such as 2-ethyl hexyl acetate. By compatible is meant solvents that will blend with tertiary butyl acetate and will be a solvent for the rubber composition.

The solvent is selected so as to be compatible with (i.e., not unduly attack) the microcells, fibers, or other solid or polymeric additives, and/or the polymeric sleeve, and or the reinforcing film or carrying film, which may in either case be Mylar, if any of these exist in the sprayed composition or on the substrate to be sprayed.

Suitable solvents may include ketones such as methyl ethyl ketone, methyl isobutyl ketone, methyl amyl ketone, 1,4 pentanedione, low molecular weight esters such as ethyl acetate, hexyl acetate, the isomers of t-butyl acetate, i.e. n-butyl acetate, secondary butyl acetate and isobutyl acetate; and aromatic hydrocarbons such as toluene and xylene. U.S. Pat. No. 6,207,224 suggests using a mixture of solvents containing at least 50% to butyl acetate will not attack certain plastics.

It is recognized that the cured printing blanket will contain substantially no solvent, and few if any of the polymeric compounds mentioned as ingredients. The compositions and solvent concentrations are expressed as what would be found when the composition is applied to the printing blanket, before drying, curing, and vulcanization.

Printing blankets made by the spray coating method of the present invention can comprise a printing sleeve, a compressible layer, optionally a reinforcing layer, optionally an adhesive layer, and a printing face.

There are one or more elastomeric rubbers that are useful in the present invention and which can include, but are not limited to: natural rubber, polyisoprene rubbers, polyisobutylene rubbers, polybutadiene rubbers, chloroprene rubbers (e.g., such as those commercially available under the tradename NEOPRENE from DuPont Chemical), nitrile rubbers (e.g., such as acrylonitrile-butadiene copolymers, or NBRs, commercially available under the tradename NIPOL from Zeon Chemicals Inc. or under the tradename PARACRIL from Uniroyal), butyl rubbers, silicone rubbers, fluorinated rubbers (e.g., such as those commercially available under the tradename Viton from DuPont Chemical), polysulfides (e.g., such as those commercially available under the tradename THIOKOL from Rohm & Haas), copolymer rubbers (e.g., random, alternating, block, multiblock, graft, multigraft, comb, star, branched, and/or dendritic copolymers comprising at least one of ethylene, propylene, butadiene, isoprene, styrene, isobutylene, and the like, fully or partially hydrogenated versions thereof, or a combination thereof, which may include, but are not limited to, EPDM, EPR, SBR, SBS, SIS, SEBS, SEPS, SEEPS, or combinations thereof), and the like, as well as mixtures or copolymers thereof. In one preferred embodiment, the one or more elastomeric rubbers comprises a nitrile rubber. In another preferred embodiment, the one or more elastomeric rubbers consists essentially of one or more nitrile rubbers.

There are one or more additives and/or processing aids that are useful in the invention which may include, but are not limited to:

organic or inorganic low molecular weight fillers and/or reinforcing agents (e.g. clay; talc; glass fibers; mica; calcium metasilicate; barium sulfate; zinc sulfide; lithopone; silicates; silicon carbide; diatomaceous earth; carbonates such as calcium carbonate and magnesium carbonate; silica such as that commercially available under the tradename HISIL from PPG Industries; particulate carbonaceous materials such as graphite, carbon black (e.g., commercially available from Cabot), cotton flock, natural bitumen, and cellulose flock; micro balloons such as glass and ceramic; fly ash; or the like; or combinations thereof), preferably silica and/or carbon black, more preferably, where carbon black is used, a mixture of grades may be used, but preferably a single grade of carbon black is used, more preferably the Cabot N550 grade of carbon black;

tackifying additives (e.g., coumarone-indene or lignin, i.e., wood resins, such as those commercially available under the tradename FF from Hercules;

phenol-formaldehyde resins, such as those commercially available under the tradename P-87 from Akrochem; and the like, or combinations thereof);

homogenization agents (e.g., plasticizing organic oils, such as those aromatic oils commercially available under the tradename SUNDEX from Sun, di(butoxy-ethoxy-ethyl) formal, which is available under the tradename TP-90B from Rohm & Haas, or the like, or a mixture thereof;

oligomeric/polymeric oils, such as polyester phthalate, which is available commercially under the tradename PLASTHALL from CP Hall, mixed phthalate oils, such as those commercially available under the tradename PALANTIOL from BASF, or the like, or a mixture thereof; or the like; or a combination thereof);

formability enhancers (e.g., factices or vulcanized oils, such as crosslinked vegetable oil, which can be obtained commercially under the tradename RHENOPRENE from Bayer);

reaction controlling compounds (e.g., retarding agents, such as those commercially available under the tradename PVI from Vanderbilt);

pigments (e.g., white pigments, such as (rutile) titania which is commercially available from DuPont or, in combination with nitrile rubber, from Polymerics; blue pigments, such as 12973 Blue, which is commercially available from Harwick; and the like; or combinations thereof);

surface active compounds (e.g., silane compounds, such as organosilanes commercially available, inter alia, from Degussa);

and the like; or a mixture thereof.

The crosslinking agent according to the invention may include one or more compounds that facilitate the crosslinking/vulcanization of the elastomeric rubber component and may advantageously include, but is not limited to:

accelerators (for example, organic sulfur-containing compounds, such as sulfenamides, e.g., mercaptobenzothiazole sulfenamide or N-tert-butylbenzothiazole sulfenamide, which are both commercially available, in combination with EPR, under the tradename RHENOGRAN from Rhein Chemie; tetraethylthiuram, which is commercially available under the tradename TETD from Akrochem; tetramethylthiuram, which is commercially available under the tradename TMTD from Akrochem; carbamide compounds, such as those commercially available under the tradename BUTYL-8; dithiodimorpholine, which is commercially available under the tradename VANAX from Vanderbilt; or the like; or a combination thereof);

activators (e.g., zinc oxide, which is commercially available, in combination with EPR, under the tradename RHENOGRAN from Kenrich; magnesium oxide, which is commercially available under the tradename MAGLITE from CP Hall and which is also useful to alter the hydrophilicity of the composition; polyethylene glycol, such as that commercially available under the tradename CARBOWAX from Union Carbide, and which is also useful to alter the hydrophilicity of the composition; or the like; or combinations thereof;

sulfur compounds (e.g., elemental sulfur or other sulfur source, such as P-80, which is commercially available from Akrochem, in combination with SBR; SPIDER SULFUR, which is commercially available from Alaochem; or the like; or a combination thereof);

acidic dispersants (e.g., organic fatty acids having a number average molecular weight below about 500, such as stearic acid or the like);

or the like; or a combination thereof.

There are also one or more antioxidants that may include, but are not limited to, one or more of the following, or combinations thereof:

(i) Phenol and/or alkylated monophenols;
(ii) Hydroquinones and/or alkylated hydroquinones;
(iii) Tocopherols;
(iv) Hydroxylated thiodiphenyl ethers;
(v) Bisphenol and/or alkylidenebisphenols;
(vii) O-, - and S-benzyl compounds;
(vii) Hydroxybenzylate malonates;
(viii) Aromatic hydroxybenzyl compounds;
(ix) Triazine compounds;
(x) Benzylphosphonates;
(xi) Acylaminophenols;
(xii) Ascorbic acid (Vitamin C);
(xiii) Aminic antioxidants such as hydroquinoline; phenylenediamine; and/or derivatives or mixtures thereof;
(xiv) UV-absorbers and light stabilizers;
(xv) Phosphites and phosphonites;
(xvi) Hydroxylamines;
(xvii) Thiosynergists such as dilauryl thiodipropionate, distearyl thiodipropionate, and mixtures thereof;
(xviii) Peroxide scavengers such as esters of-thiodipropionic acid, for example the lauryl, stearyl, myristyl or tridecyl esters; mercaptobenzimidazole or the zinc salt of 2-mercaptobenzimidazole; zinc 2-mercaptotoluimidazole; zinc dibutyldithiocarbarnate; dioctadecyl disulfide; pentaerythritol tetrakis(-dodecylmercapto) propionate; and mixtures thereof;

or mixtures thereof.

In a preferred embodiment, the at least one antioxidant is selected from the group consisting of zinc 2-mercaptotoluimidazole, bis-phenol, phenol, phenylenediamine, hydroquinoline, and any combination thereof.

The compressible layer composition according to the invention may advantageously include about 100 parts of one or more elastomeric rubbers; one or more additives and/or processing aids; a crosslinking agent; and one or more antioxidants.

In a preferred embodiment, the one or more compressible layer elastomeric rubbers comprises at least one nitrile rubber, preferably at least one nitrile rubber copolymer having an acrylonitrile content from about 25% to about 41%, more preferably from about 30% to about 40%, most preferably from about 33% to about 37%. In this preferred embodiment, the at least one compressible layer nitrite rubber copolymer possesses an average acrylonitrile content from about 33% to about 40%, preferably from about 33% to about 37%. In a more preferred embodiment, the one or more compressible layer elastomeric rubbers comprises a terpolymer made from acrylonitrile and butadiene monomers, and preferably also containing isoprene monomers. Preferred terpolymers contain at least about 25%, more preferably at least about 30%, of each of the monomer components. More preferably, the terpolymer comprises acrylonitrile in an amount from about 33% to about 40%, butadiene in an amount from about 30% to about 40%, and another monomer component, preferably isoprene, in an amount from about 30% to about 40%. The compressible layer elastomeric rubber may contain a mixture of rubber homopolymers or copolymers containing acrylonitrile monomers, and preferably contains at least about 50%, more preferably at least about 80%, most preferably at least about 90%, of the acrylonitrile-butadiene-isoprene terpolymer.

In addition to about 100 parts rubber, a compressible layer composition according to the present invention may preferably comprise: microspheres present in an amount from about 1 to about 10 pph rubber; crosslinking agents present in an amount from about 5 to about 35 pph rubber, preferably from about 8 to about 25 pph rubber, more preferably from about 10 to about 20 pph rubber; one or more antioxidants present in an amount not more than about 15 pph rubber, preferably from about 0.5 to about 10 pph rubber, more preferably from about 1 to about 8 pph rubber; and additives and/or processing aids present in an amount not more than about 90 pph rubber, preferably from about 15 to about 85 pph rubber, more preferably from about 25 to about 75 pph rubber, most preferably from about 30 to about 70 pph rubber.

In preferred embodiments, a compressible layer composition according to the present invention may possess one or more of the following: a carbon black content from about 12 to about 28 pph rubber; a microsphere content from about 1 to about 10 pph rubber; a retarding agent content from about 0.1 to about 1.5 pph rubber, a resin content from about 10 to about 24 pph rubber, an oil content from about 10 to about 22 pph rubber, a phenol content from about 0.1 to about 3 pph rubber; a zinc 2-mercapto-toluimidazole content from about content. from about 0.1 to about 3 pph rubber; a phenylenediamine content from about 0.1 to about 3 pph rubber; a sulfur donor content from about 2 to about 4 pph rubber; an accelerator content from about 1 to about 7 pph rubber; a sulfur content from about 1 to about 2.5 pph rubber; a stearic acid content from about 0.1 to about 3 pph rubber; an activator content from about 5 to about 15 pph rubber; and/or a combination thereof.

In one preferred embodiment, the one or more antioxidants includes a phenolic antioxidant, a peroxide scavenger, an aminic antioxidant, or a combination thereof Optionally, an adhesive layer may be included in a printing blanket according to the invention, in order to adhere the compressible layer to the metallic or polymeric printing sleeve.

The printing face according to the invention may advantageously include one or more elastomeric rubbers; one or more additives and/or processing aids; a crosslinking agent; and one or more antioxidants.

In a preferred embodiment, the one or more printing face layer elastomeric rubbers comprises at least one nitrile rubber copolymer having an acrylonitrile content from about 25% to about 41%, preferably from about 35% to about 40%. In this preferred embodiment, the at least one printing face layer-nitrile rubber copolymer possesses an average acrylonitrile content from about 36% to about 40%. One preferred printing face layer nitrile rubber copolymer includes butadiene monomers, as well as acrylonitrile monomers, and optionally, but less preferably a few percent of one or more other comonomers. Preferably, the butadiene content of the printing face layer nitrile rubber copolymer is at least about 55%, preferably at least about 59%, more preferably from about 59% to about 61%. The printing face layer elastomeric rubber may contain a mixture of rubber homopolymers or copolymers containing acrylonitrile monomers, and preferably contains at least about 50%, more preferably at least about 80%, most preferably at least about 90%, of the acrylonitrile-butadiene copolymer.

In one embodiment, the printing face layer elastomeric rubber component comprises a mixture of nitrile rubbers. In another embodiment, the acrylonitrile content of the at least one printing face layer nitrile rubber copolymer can be from about 30% to about 37%, or the average acrylonitrile content of all the included printing face layer nitrile rubber copolymers can be from about 33% to about 37%. In still another embodiment, the one or more printing face layer elastomeric rubbers does not include a polysulfide.

In addition to about 100 parts rubber, a printing face layer composition according to the invention may preferably comprise: crosslinking agents present in an amount from about 5 to about 35 pph rubber, preferably from about 8 to about 25 pph rubber, more preferably from about 10 to about 20 pph rubber; one or more antioxidants present in an amount not more than about 15 pph rubber, preferably from about 0.5 to about 10 pph rubber, more preferably from about 1 to about 8 pph rubber; and additives and/or processing aids present in an amount not more than about 120 pph rubber, preferably from about 20 to about 110 pph rubber, more preferably from about 40 to about 100 pph rubber, most preferably from about 55 to about 95 pph rubber.

In these preferred embodiments, the printing face layer composition according to the present invention may possess one or more of the following: a silica content from about 12 to about 30 pph rubber; a retarding agent content from about 0.5 to about 4 pph rubber; a resin content from about 2 to about 10 pph rubber; a non-vulcanized oil content from about 10 to about 30 pph rubber; a factice content from about 10 to about 30 pph rubber; an organosilane content from about 1 to about 5 pph rubber, a pigment content from about 5 to about 25 pph rubber; a hydroquinoline content from about 0.1 to about 3 pph rubber, a zinc 2-mercapto-toluimidazole content from about content from about 0.1 to about 3 pph rubber; a phenylenediamine content from about 0.5 to about 3 pph rubber, a sulfur donor content from about 1 to about 4 pph rubber; an accelerator content from about 0.1 to about 3 pph rubber; a sulfur content from about 0.5 to about 3 pph rubber, a stearic acid content from about 0.5 to about 4 pph rubber; an activator content from about 5 to about 15 pph rubber; and/or a combination thereof.

In other embodiments, a printing face layer composition according to the present invention may comprise: crosslinking agents present in an amount from about 5 to about 35 pph rubber, preferably from about 8 to about 25 pph rubber, more preferably from about 8 to about 20 pph rubber, one or more antioxidants present in an amount not more than about 10 pph rubber, preferably from about 0.1 to about 5 pph rubber, more preferably from about 0.5 to about 3 pph rubber; and additives and/or processing aids present in an amount not more than about 85 pph rubber, preferably from about 15 to about 75 pph rubber, more preferably from about 25 to about 70 pph rubber, most preferably from about 30 to about 65 pph rubber.

In these other embodiments, the printing face layer composition according to the present invention may preferably possess one or more of the following: from about 20 to about 40 parts of a polysulfide component; from about 5 to about 20 pph of silica; from about 10 to about 30 pph of a factice;

from about 0.1 to about 5 pph of a phenolic antioxidant; from about 3 to about 12 pph of pigment; from about 1 to about 10 pph of an accelerator, from about 4 to about 10 pph of a non-vulcanized oil; from about 0.1 to 1.5 pph of a retarding agent; from about 0.1 to 3 pph of stearic acid; from about 3 to about 15 pph of an activator; and/or a combination thereof.

In another preferred embodiment, the one or more printing face layer additives and/or processing aids includes a factice, at least one pigment, a retarding agent, an inorganic filler, or a combination thereof.

The adhesive layer composition according to the invention may advantageously include about 100 parts of one or more elastomeric rubbers; one or more additives and/or processing aids; a crosslinking agent; and one or more antioxidants.

In a preferred embodiment, the one or more adhesive layer elastomeric rubbers comprises at least one nitrile rubber copolymer having an acrylonitrile content from about 25% to about 41%, preferably from about 30% to about 35%. In this preferred embodiment, the at least one adhesive layer nitrile rubber copolymer possesses an average acrylonitrile content from about 30% to about 35%. One preferred adhesive layer nitrile rubber copolymer includes butadiene monomers, as well as acrylonitrile monomers, and optionally, but less preferably a few percent of one or more other comonomers. Preferably, the butadiene content of the adhesive layer nitrile rubber copolymer is at least about 60%, preferably at least about 65%, more preferably from about 66% to about 68%. The adhesive layer elastomeric rubber may contain a mixture of rubber homopolymers or copolymers containing acrylonitrile monomers, and preferably contains at least about 50%, more preferably at least about 80%, most preferably at least about 90%, of the acrylonitrile-butadiene copolymer.

In addition to about 100 parts rubber, an adhesive layer composition according to the present invention may preferably comprise: crosslinking agents present in an amount from about 2 to about 30 pph rubber, preferably from about 4 to about 25 pph rubber, more preferably from about 6 to about 20 pph rubber; one or more antioxidants present in an amount not more than about 10 pph rubber, preferably from about 0.1 to about 8 pph rubber, more preferably from about 0.5 to about 6 pph rubber; and additives and/or processing aids present in an amount not more than about 95 pph rubber, preferably from about 15 to about 90 pph rubber, more preferably from about 25 to about 85 pph rubber, most preferably from about 35 to about 80 pph rubber.

In preferred embodiments, the adhesive layer composition according to the present invention may possess one or more of the following: a silica content from about 20 to about 55 pph rubber; a non-vulcanized oil content from about 10 to about 30 pph rubber, an organosilane content from about 0.5 to about 3 pph rubber; a pigment content from about 3 to about 20 pph rubber, a bis-phenol content from about 0.5 to about 6 pph rubber; an accelerator content from about 1 to about 10 pph rubber; a sulfur content from about 0.5 to about 4 pph rubber; an activator content from about 2 to about 12 pph rubber, and/or a combination thereof.

In one embodiment, an adhesive layer according to the invention is disposed between the printing face and the compressible layer. In another embodiment, an adhesive layer according to the invention is disposed between the printing face and a reinforcing layer. In still another embodiment, an adhesive layer according to the invention is disposed between a reinforcing layer and the compressible layer. In any of these embodiments, the adhesive layer may advantageously function as an adhesive or compatibilizer for the two layers between which it is disposed.

In a preferred embodiment, the one or more adhesive layer elastomeric rubbers comprises at least one nitrile rubber copolymer having an acrylonitrile content from about 25% to about 41%, preferably from about 30% to about 37%. In this preferred embodiment, the at least one adhesive layer nitrile rubber copolymer possesses an average acrylonitrile content from about 30% to about 37%.

In some embodiments, tackifying the nickel sleeve is not required before spraying elastomers thereon.

EXAMPLES

Example 1

Compressible Layer Composition for Use in a Printing Blanket According to the Invention The composition of the compressible layer of Example 1 is delineated in the table below. NIPOL DN1201 is a terpolymer containing about 35% acrylonitrile, about 33% butadiene, and about 32% isoprene.

| COMPONENT | EXAMPLE 1 (PPH RUBBER) | COMPONENT RANGES (PPH RUBBER) |
|---|---|---|
| NIPOL DN1201 nitrile rubber | 100 | About 100 parts rubber |
| N550 Carbon black | 20 | From about 10 to about 40 |
| EXPANCEL microspheres | 5.5 | From about 1 to about 10 |
| Phthalimide | 0.5 | Not more than about 2 |
| FF Wood Resin | 8 | From about 2 to about 14 |
| SUNDEX 790 aromatic oil | 16 | From about 2 to about 25 |
| P-87 phenol formaldehyde resin | 7 | From about 1 to about 15 |
| Phenol | 1 | Not more than about 3 |
| Zinc 2-mercapto-toluimidazole | 1 | Not more than about 3 |
| Phenylenediamine | 1 | Not more than about 3 |
| Dithiodimorpholine | 3 | From about 1 to about 5 |
| BUTYL-8 carbamide compound | 2 | From about 0.5 to about 5 |
| Tetraethylthiuram | 2 | From about 0.25 to about 4 |
| Spider Sulfur | 1.5 | From about 0.25 to about 2.5 |
| Stearic Acid | 1 | Not more than about 4 |
| Zinc Oxide (85%, KENRICH French Process) | 9 | From about 2.5 to about 40 |

The ingredients above were combined using a BANBURY mixer and open mill. Temperature, mixing strength, and order of addition of ingredients was controlled so that the composition was homogenized but such that there was substantially no interference with fabrication of the compressible layer via premature activation of the crosslinking or vulcanization reaction. Once the compressible layer composition of Example 1 was sufficiently mixed, a sufficient amount of an organic solvent, e.g., toluene, was added to the resultant mixture in order to facilitate deposition on, and compatibilization with, the substrate upon which the compressible layer composition was deposited (i.e., a metallic or polymeric sleeve).

The compressible layer composition of Example 1, as fabricated, exhibited a Shore A hardness of approximately 54.

Printing blankets were also fabricated incorporating the compressible layer of Example 1, as described above. A reinforcing layer, comprising the above composition without the microspheres can be disposed above or below the compressible layer of Example 1.

Example 2

Printing Face Composition for Use in a Printing Blanket According to the Invention The composition of the printing face layer of Example 2 is delineated in the table below. The NIPOL VT rubbers are copolymers of acrylonitrile and butadiene, each having a Mooney viscosity of approximately 80. The composition of the 380 rubber is approximately 30/70 acrylonitrile/butadiene; the composition of the 480 rubber is approximately 40/60 acrylonitrilelbutadiene; and the composition of the 3380 rubber is approximately 33/67 acrylonitrile/butadiene.

| INGREDIENT | INDIVIDUAL COMPONENTS |
|---|---|
| NIPOL VT380 nitrile rubber | From about 10 to about 20 parts |
| NIPOL VT480 nitrile rubber | From about 10 to about 20 parts |
| NIPOL DN3380 nitrile rubber | From about 25 to about 50 parts |
| THIOKOL Polysulfide | From about 15 to about 45 parts |
| HISIL 233 silica | From about 2 to about 30 parts |
| RHENOPRENE C crosslinked vegetable oil | From about 5 to about 40 parts |
| Stearic Acid | Not more than about 5 parts |
| NAUGAWHITE bis-phenol | Not more than about 10 parts |
| RHENOGRAN ZN0-85 (85% ZnO IN EPR) | From about 1 to about 20 parts |
| Phthalimide | Not more than about 2 parts |
| POLY-DISPERSION A(TI)D-80 (80% TIO2 IN NBR) | Not more than about 10 parts |
| 12973 Blue pigment | From about 0.5 to about 10 parts |
| RHENOGRAN MBTS-75 (75% sulfenamide IN EPR) | From about 0.5 to about 10 parts |
| tetramethylthiuram | From about 0.5 to about 5 parts |
| di(butoxy-ethoxy-ethyl) formal oil | From about 2 to about 15 parts |

The ingredients above were combined using a BANBURY mixer and open mill. Temperature, mixing strength, and order of addition of ingredients was controlled so that the composition was homogenized but such that there was substantially no interference with fabrication of the compressible layer via premature activation of the crosslinking or vulcanization reaction.

Printing blankets were also fabricated incorporating the printing face layer of Example 2. This was accomplished by extruding the composition and disposing the composition over a compressible layer, or optionally over an adhesive layer that is disposed upon a reinforcing layer and/or the compressible layer.

Example 3

Printing Face Composition for Use in a Printing Blanket According to the Invention The composition of the printing face layer of Example 3 is delineated in the table below. NIPOL 4050 is a copolymer containing approximately 40% acrylonitrile and about 60% butadiene.

| INGREDIENT | EXAMPLE 3 (PPH RUBBER) | COMPONENT RANGES (PPH RUBBER) |
|---|---|---|
| NIPOL 4050 nitrile rubber | 100 | About 100 parts |
| DURASIL 880 Silica | 20 | From about 5 to about 50 |
| DEGUSSA SI-69 organosilane | 3 | From about 0.5 to about 6 |

-continued

| INGREDIENT | EXAMPLE 3 (PPH RUBBER) | COMPONENT RANGES (PPH RUBBER) |
|---|---|---|
| AKROCHEM P-87 phenol formaldehyde resin | 5 | From about 2 to about 10 |
| RHENOPRENE EPS crosslinked vegetable oil | 20 | From about 5 to about 40 |
| PLASTHALL P-900 polyester phthalate oil | 20 | From about 5 to about 35 |
| MAGLITE K (magnesium oxide) | 3 | Not more than about 10 |
| AKROCHEM DQ (hydroquinoline) | 1 | Not more than about 5 |
| VANOX ZMTI (zinc 2-mercapto-toluimidazole) | 1 | Not more than about 5 |
| HARWICK 12973 Blue pigment | 4 | From about 0.5 to about 10 |
| POLYMERICS 80% TiO2 White pigment | 10 | From about 2 to about 25 |
| Phenylenediamine | 2 | Not more than about 5 |
| Dithiodimorpholine | 2 | From about 1 to about 5 |
| Tetraethylthiuram | 0.5 | From about 0.25 to about 4 |
| Pthalimide | 2 | Not more than about 2 |
| AKROCHEM P-80 sulfur (80% sulfur in SBR) | 1.5 | From about 0.5 to about 3 |
| Stearic Acid | 2 | From about 0.5 to about 4 |
| Zinc Oxide (85% KENRICH French Process) | 5 | From about 2.5 to about 40 |

The ingredients above were combined using a BANBURY mixer and open mill. Temperature, mixing strength, and order of addition of ingredients was controlled so that the composition was homogenized but such that there was substantially no interference with fabrication of the compressible layer via premature activation of the crosslinking or vulcanization reaction.

Increased hydrophilicity can be advantageous in printing faces of the invention. The printing face of Example 3 shows more hydrophilic character than the printing face described in Example 2. Without being bound to theory, it is surmised that the addition of the polyester phthalate oil and the magnesium oxide co-accelerator result in the increased hydrophilicity of the composition in Example 3.

Printing blankets were also fabricated incorporating the printing face layer of Example 3. Similarly to that described in Example 2, this was accomplished by extruding the composition and disposing the composition over a compressible layer, or optionally over an adhesive layer that is disposed upon a reinforcing layer and/or the compressible layer.

Example 4

Adhesive Layer Composition for Use in a Printing Blanket According to the Invention The composition of the adhesive layer of Example 4 is delineated in the table below. PARACRIL BJLT M-50 is a 33/67 copolymer of acrylonitrile and butadiene.

| INGREDIENT | EXAMPLE 4 (PPH RUBBER) | COMPONENT RANGES (PPH RUBBER) |
|---|---|---|
| PARACRIL BJLT M-50 nitrile rubber | 100 | About 100 parts |
| HISIL 233 silica | 40 | From about 5 to about 50 |
| DEGUSSA SI-69 organosilane | 0.8 | From about 0.5 to about 3 |
| CARBOWAX 3350 polyethylene glycol | 3 | From about 0.5 to about 6 |
| NAUGAWHITEä bis-phenol | 2 | Not more than about 10 |
| HARWICK 12973 Blue pigment | 3.5 | From about 0.5 to about 10 |
| DuPont R-900 (RUTILE) titanium dioxide | 5 | From about 1 to about 20 |
| PALANTIOL 711P mixed 7-11 phthalate oil | 15 | From about 5 to about 40 |
| RHENOGRAN ZN0-85 (85% ZnO IN EPR) | 3 | From about 0.5 to about 10 |
| Tetraethylthiuram | 0.5 | From about 0.1 to about 3 |
| RHENOGRAN TBBS-75 (75% sulfenamide IN EPR) | 2 | From about 0.5 to about 10 |
| AKROCHEM P-80 sulfur (80% sulfur in SBR) | 2 | From about 0.5 to about 10 |

The ingredients above were combined using a BANBURY mixer and open mill. Temperature, mixing strength, and order of addition of ingredients was controlled so that the composition was homogenized but such that there was substantially no interference with fabrication of the compressible layer via premature activation of the crosslinking or vulcanization reaction. Once the adhesive layer composition of Example 4 was sufficiently mixed, a sufficient amount of an organic solvent, e.g., toluene, was added to the resultant mixture in order to facilitate deposition on, and compatibilization with, the compressible layer.

Printing blankets were also fabricated incorporating the adhesive layer of Example 4. This was accomplished by depositing a thin layer of the mixed composition, including the solvent (e.g., from about 0.1 to about 5 mils thick, preferably from about 0.5 to about 3 mils thick) onto the vulcanized or partially vulcanized compressible layer (e.g., usually one that has already been deposited on a substrate printing sleeve) or onto a reinforcing layer diposed upon the compressible layer. This layer may serve as an adhesive, or at least as a compatibilizing layer, between the compressible layer or a reinforcing layer and a printing face deposited upon the adhesive layer. Alternately, the layer may serve as an adhesive; or at least as a compatibilizing layer, between the compressible layer and a reinforcing layer deposited upon the adhesive layer. The adhesive layer may be especially useful in adhering a vulcanized or partially vulcanized layer to an unvulcanized layer.

Example 5

Tests of Printing Blanket According to the Invention

In the printing industry that there are many factors that enter into the utility of a printing blanket. In addition to the basic properties of the layers, the blanket must have the appropriate acidity and wettability, the required stiffness but also the required compressibility, and the layer formulations must not creep or show signs of age while in operation. During typical operation, a blanket is expanded and placed on a roller, rotated at a high velocity while being coated with different ink formulations while compressing against both paper and other rollers, nips, and the like, and must be able to survive impacts when multiple pieces of printing substrate, i.e., paper, are accidently jammed in the small tolerances between the blanket and the roller. As a result, no printing blanket formulations can be considered useful unless they have been tested on a printer. Printing blankets using the formulations of Example 1 for the compressible layer, Example 4 for the adhesive, and either Example 2 or Example 3 (marked EXP-350 for the printing face), were prepared using electrostatic-spray-on technology. These sleeves have no threads, and are manufactured by providing a primed nickel sleeve;

electrostatic spraying on the compressible layer onto the nickel sleeve;

at least partially vulcanizing the compressible layer;

optionally grinding the compressible layer;

applying the adhesive over at least partially vulcanized compressible layer;

electrostatic spraying of the printing face formulary of either example 2 or example 3;

vulcanizing the rubbers in the sleeve; and grinding the printing face to a tolerance of about 1 micron.

The tests were Four-Color Catalogs printed on a SUNDAY PRESS™ available from Heidelberger Druckmaschinen AG, Heidelberg, Del. A four color test is a rigorous test as multiple rollers must act in concert to provide acceptable registration as the printing substrate passes from one roller to the next. In these tests, there was no Process Color in Unit #1, Black was in Unit #2. A print run was started with commercially available sleeves which were run for about 350,000impressions. The print operating data from the prior art commercial sleeves is shown in Table 1.

TABLE 1

| | Unit | Compliancy | Temperature Oper. | Temperature Gear |
|---|---|---|---|---|
| Com. 1 | #2 - Upper Black | 42 | 90 | 92 |
| Com. 2 | #2 - Lower Black | 42 | 95 | 92 |
| Com. 3 | #3 - Upper Cyan | 40 | 95 | 96 |
| Com. 4 | #3 - Lower Cyan | 40 | 95 | 96 |
| Com. 5 | #4 - Up. Magenta | 41 | 95 | 97 |
| Com. 6 | #4 - Lo. Magenta | 41 | 96 | 99 |
| Com. 7 | #5 - Upper Yellow | 43 | 98 | 97 |
| Com. 8 | #5 - Lower Yellow | 43 | 98 | 99 |

The sleeves of this invention, which contained no threads and the printing face formulary of Example 2, were then installed. Printing was within 0.020" on register and color looked good, and after warmup of about 2,000 sheets the print was of commercial quality.

The water was reduced, and the print quality improved marginally. These sleeves were consumed after 1–1.5 million impressions.

In the next test, the sleeves were gradually replaced EXP-350 sleeves, that is, the printing face formulary of Example 3, of this invention. A second catalog was printed, again with 4 colors. The color was of commercial quality, but after about 400,000impressions three of the sleeves were pulled. Two bad pinholes or blisters and one had ink piling.

These three sleeves were replaced with EXP-350s. Ultimately, one was on the black unit and two were on the Magenta unit. The register and color were fine and no noticeable difference was observed by the Press Crew. The sleeves ran 0.9 million impressions.

The printing face formulary of Example 2 has a tensile strength less than 1000 psi. The tensile strength of the printing face formulary of Example 3 exhibits greater than 1000 psi but less than 6000 psi tensile values.

All experimental sleeves went on easily, without need of lubricant. The tests were run at 1400 to 2700 feet per hour, and 14000–88000 impressions per hour. Table 2 describes the print operating data for the Sleeves with printing face formulary of Example 2 that replaced the commercial sleeves listed above, when run at 2400 feet per hour and 78000 impressions per hour, where Id. is an identification number.

TABLE 2

| I.D. | Unit | Temperature Oper. | Temperature Gear |
|---|---|---|---|
| 6044 | #2 - Upper Black | 98 | 99 |
| 6670 | #2 - Lower Black | 97 | 100 |
| 9432 | #3 - Lower Cyan | 101 | 100 |
| 9410 | #3 - Upper Cyan | 99 | 97 |
| 6835 | #4 - Lower Magenta | 102 | 98 |
| 9436 | #4 - Upper Magenta | 103 | 100 |
| 4447 | #5 - Upper Yellow | 100 | 101 |
| 6675 | #5 - Lower Yellow | 102 | 101 |

The temperature is recorded because it is desirable to control both gear and operating temperatures within prescribed limits. The blankets must not generate excessive heat during operation, and must be able to dissipate the heat generated.

No bustle wheels were needed and the sheet looked good. The operators mentioned that they have problems printing wide webs >52" with commercial sleeves, where the registration on the ends varies from the rest of the sleeve on wide webs. At the time this was checked there were 500,000 impressions on the plates and the problem was not observed with the experimental sleeves. The printing was done on 50 weight paper DESPERADO™ Web Paper from Mead. The print job was a Catalog that was 44½" wide.

We have surprisingly found that the thicker compressible layer and the relatively lower compliancy of the composition allow the locust of many points to act as independent springs. On a 57" long Sleeve, it is estimated that the core deflects between 0.003–0.004" from the center to the ends during high speed operation. The center deflects more than the ends. In a traditional sleeve of the prior art, to compensate for the deflection, the ends are step ground or profiled. The sleeve of the prior art includes wound inextensible thread layer that require the step grind. The new sleeves of this invention contain no such inextensible layer, that is, the nickel is inextensible but the compressible layer and the face later are 100% elastomeric. Elastomers with a 5060 Shore A hardness are considered elastic. The compressible layer formulations contain 4.5% & 5.5% by weight microspheres. The range of microspheres can be 1–7% with the preferred being 2.5–6.0% and most preferred being 5.0–5.5%. Though these sleeves had a profiled grind of a layer, sleeves of this invention in some embodiments have been surprisingly found to not need profile grinding. The following data was obtained with sleeves of at 2407 feet per hour.

| Sleeve ID | Unit | Temperature (F.) Oper. | Temperature (F.) Gear | Comments |
|---|---|---|---|---|
| 6044 | #2 - Upper Black | 97 | 97 | Job running smooth |
| 6670 | #2 - Lower Black | 98 | 101 | 90,000 impressions |
| 6816 | #3 - Upper Cyan | 97 | 100 | |

-continued

| Sleeve ID | Unit | Temperature (F.) Oper. | Temperature (F.) Gear | Comments |
|---|---|---|---|---|
| 9432 | #3 - Lower Cyan | 101 | 100 | |
| 9436 | #4 - Upper Magenta | 103 | 101 | |
| 9435 | #4 - Lower Magenta | 103 | 104 | |
| 6675 | #5 - Upper Yellow | 103 | 102 | |
| 4447 | #5 - Lower Yellow | 101 | 103 | |

The speed of the press was increased to 2503 feet per hour (81,000 impressions per hour) and the following temperature data was obtained after 205,000 impressions and after temperature was increased 2 degrees F. and then brought back down after 292,000 net impressions were made.

| Sleeve ID impressions | Unit | Temperature Oper. | Temperature Gear | Temperature @ 292,000 Oper. | Temperature @ 292,000 Gear |
|---|---|---|---|---|---|
| 6044 | #2 - Upper Black | 100 | 100 | 96 | 96 |
| 6670 | #2 - Lower Black | 103 | 100 | 96 | 97 |
| 6816 | #3 - Upper Cyan | 98 | 101 | 98 | 99 |
| 9432 | #3 - Lower Cyan | 101 | 101 | 99 | 104 |
| 9436 | #4 - Upper Magenta | 105 | 101 | 105 | 100 |
| 9435 | #4 - Lower Magenta | 102 | 104 | 100 | 100 |
| 6675 | #5 - Upper Yellow | 104 | 101 | 104 | 100 |
| 4447 | #5 - Lower Yellow | 101 | 104 | 102 | 103 |

At 379,000impressions the temperature remained fairly stable, and washup was easy. At 500,000 impressions the #2—Upper Black sleeve blew out, and shortly thereafter the #4—Upper Magenta and #4—Lower Magenta sleeves were replaced due to pin holes. The sleeves reached 125 degrees F. after removal from the press. There was a slight registration problem after these sleeves were replaced with EXP-350 sleeves with the printing face formulary of Example 3, but the quality was soon commercially acceptable. The operating temperature at 2100 feet per hour (68,000 impressions per hour) were:

| Sleeve ID | Unit | Temperature Oper. | Temperature Gear |
|---|---|---|---|
| 9441 | #2 - Upper Black | 92 | 91 |
| 6670 | #2 - Lower Black | 93 | 94 |
| 6810 | #3 - Upper Cyan | 95 | 97 |
| 9432 | #3 - Lower Cyan | 95 | 98 |
| 157 EXP-350 | #4 - Upper Magenta | 99 | 96 |
| 021 EXP-350 | #4 - Lower Magenta | 96 | 97 |
| 6675 | #5 - Upper Yellow | 100 | 97 |
| 4447 | #5 - Lower Yellow | 96 | 100 |

With these sleeves in place a new 4-color Catalog job was started using 38# paper Drapers Gloss™ and a 46½" wide web. The 9441 sleeve was damaged during transition and was replaced. Operating conditions were:

| Sleeve ID | Unit | Temperature Oper. | Temperature Gear |
|---|---|---|---|
| 9443 | #2 - Upper Black | 105 | 96 |
| 6670 | #2 - Lower Black | 109 | 106 |
| 6810 | #3 - Upper Cyan | 106 | 105 |
| 9432 | #3 - Lower Cyan | 112 | 105 |
| 157-EXP-350 | #4 - Upper Magenta | 110 | 106 |
| 021-EXP-350 | #4 - Lower Magenta | 96 | 95 |
| 6675 | #5 - Upper Yellow | 95 | 94 |
| 4447 | #5 - Lower Yellow | 91 | 95 |

At 247,000 impressions, the unit continued to run without problems, and operating temperatures were between 93 degrees F. and 101 degrees F., generally increasing as the unit increased. The #4—Lower Magenta gear was running at 103 degrees F., about 4 degrees hotter than the operating temperature. The remaining gear temperatures were within 2 degrees F. of the operating temperatures. Soon thereafter, several sleeves blistered and were replaced.

About 2,000,000 impressions were accumulated on the EXP-350 and the other sleeves of this invention. The print was judged to be of commercial quality and the electrostatically sprayed, no-thread sleeves of this invention were interchangeable with commercial threaded blankets.

The printing blankets with the elastomeric compositions described above and in the claims are considerably stronger than the prior art blankets. As such, the strength of wound threads which were used in the prior art to apply the compressible layer and often the printing layer, is not needed. The threads provided a substantially inelastic layer. The modulus of elasticity can be made high enough such that a reinforcing layer of threads is not needed. A preferred embodiment comprises at least one layer that has a modulus of elasticity that is between about 100 pounds per square inch and 2000 pounds per square inch, preferably between about 500 pounds per square inch and about 950 pounds per square inch, more preferably between about 700 pounds per square inch and about 900 pounds per square inch. Preferably, this layer is between about 0.006 inches and 0.047 inches in thickness. This provides strength while not giving a layer that is substantially inelastic. Inelastic layers incorporated into a cylindrical printing blanket may be responsibe for standing waves being forms at the entrance where the blanket contacts a roller.

In another embodiment, a reinforcing layer can be disposed between the compressible layer and the printing face layer. This layer may be of an elastomer composition of the printing face layer or of the compressible face layer, but with added crosslinking agents, for example up to twice the curing and crosslinking agents specified for the printing face layer or of the compressible face layer, respectively.

In another embodiment, a reinforcing layer can be a film with a modulus of elasticity of between about 1000 pounds per square inch and about 20000 pounds per square inch, preferably between about 11000 pounds per square inch and about 16000 pounds per square inch. High strength ribbons of this low elasticity film can be wound in a barber pole fashion around the printing blanket, and can be adhered to the sleeve and/or to the elastomeric layer(s) by for example an adhesive described herein. An elastomeric product may already be put on the substantially inelastic film prior to winding the film onto the substrate. This elastomeric product, preferably a printing face formulation or a compressible layer formulation with or without microcells, may be in a cured state, a partially cured but tacky state, or a substantially uncured state which may include residual solvents. The elastomeric material is beneficially facing outward so that any subsequent grinding will not affect the integrity of the film. A preferred film comprises at least one of MYLAR (TM), ARAMID (TM), KEVLAR (TM), high density polyethylene, polyester, or other film-forming polymers with high modulus/low elongation properties known in the art.

The preferred polymeric sleeve comprises one or more layers of MYLAR. The polymeric sleeve may be made by extrusion, by winding, or by a combination thereof. The polymeric sleeve may have reinforcing materials embedded therein, ir may be self-reinforced by stretching the blanket to partially orient the polymeric molecules. Said stretching can be performed at a temperature above or below the glass transition temperature.

In one embodiment sleeves that were 0.005 inches, 0.010 inches, and 0.020 inches in thickness were tested. The thickness of the polymeric sleeve in one embodiment is between about 0.004 inches and 0.28 inches, preferably between about 0.1 inches and 0.20 inches. The use of the higher strength polymeric materials described herein, which optionally includes a reinforcing layer, provides sufficient strength to the blanket that these thinner polymeric sleeves can be used.

The inner layer, the outer layer, or both of the sleeve may be treated to increase friction, reduce squealing noise, or increase adherence of other layers.

We claim:

1. A cylindrical printing blanket having a sleeve, a compressible layer, a reinforcing layer, and a printing face layer, wherein there is no thread or fiber exterior to the sleeve which extends around the sleeve in the portion of the printing blanket used for printing:

wherein at least one of the compressible layer or the reinforcing layer includes an axially oriented gradient, said gradient being either in thickness, in composition, or both, and wherein at least one layer was applied by electrostatic spraying the composition;

wherein a boundary exists between the compressible layer and the reinforcing layer, and a second boundary exists between the reinforcing layer and the printing face layer;

wherein the boundary between either the compressible layer and the reinforcing layer, the boundary between the reinforcing layer and the printing face layer, or both boundaries, includes a compositional gradient extending at least 0.004 inches radially;

wherein the composition within the radial gradient comprises a mixture of the compositions of the layers adjoining the boundary; and wherein the compositions of the adjoining layers are different.

2. The cylindrical printing blanket of claim 1 wherein the boundary containing the radial gradient is between the compressible layer and the reinforcing layer.

3. The cylindrical printing blanket of claim 1 wherein the boundary containing the radial gradient is between the reinforcing layer and the printing face layer.

4. The cylindrical printing blanket of claim 1 wherein the radial gradient is on the boundary between the reinforcing layer and the compressible layer, the compressible layer comprising porosity, and wherein the composition gradient comprises a decrease in the porosity from the porosity of the compressible layer to the lower porosity of the reinforcing layer.

5. The cylindrical printing blanket of claim 4 wherein the porosity comprises microcells.

6. The cylindrical printing blanket of claim 1 wherein the printing face layer is not tapered.

7. The cylindrical printing blanket of claim 1 wherein the compressible layer was applied by electrostatic spraying.

8. The cylindrical printing blanket of claim 1 wherein the printing face layer was applied by electrostatic spraying.

* * * * *